US009689576B2

(12) United States Patent
Johnson et al.

(10) Patent No.: US 9,689,576 B2
(45) **Date of Patent: *Jun. 27, 2017**

(54) OVEN APPLIANCE AND A METHOD FOR OPERATING AN OVEN APPLIANCE

(71) Applicant: General Electric Company, Schenectady, NY (US)

(72) Inventors: Eric Scott Johnson, Louisville, KY (US); Stephen Christopher Boedicker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 400 days.

This patent is subject to a terminal disclaimer.

(21) Appl. No.: 14/513,241

(22) Filed: Oct. 14, 2014

(65) Prior Publication Data

US 2016/0102869 A1 Apr. 14, 2016

(51) Int. Cl.
*F24C 15/32* (2006.01)
*F24C 7/08* (2006.01)

(52) U.S. Cl.
CPC ..... *F24C 15/322* (2013.01); *F24C 7/085* (2013.01)

(58) Field of Classification Search
CPC ..... F24C 15/322; F24C 7/085
USPC ..... 99/468, 476, 475, 474
See application file for complete search history.

(56) References Cited

U.S. PATENT DOCUMENTS 6,388,235 B1 5/2002 Sauter et al.

FOREIGN PATENT DOCUMENTS

| | | |
|---|---|---|
| EP | 2009958 | 12/2008 |
| EP | 2123981 | 11/2010 |

OTHER PUBLICATIONS

Co-pending U.S. Appl. No. 14/513,244 dated Oct. 14, 2014.

*Primary Examiner* — Christopher Kim
(74) *Attorney, Agent, or Firm* — Dority & Manning, P.A.

(57) ABSTRACT

An oven appliance with one or more features for minimizing the time to preheat the cooking chamber and balancing the heat distribution within the cooking chamber of the oven appliance is provided. Features for minimizing the acoustic noise of the oven appliance are also provided. Further, a method for operating an oven appliance to minimize the preheat time and balance the heat distribution within the cooking chamber of the oven appliance while minimizing acoustic noise is provided.

20 Claims, 8 Drawing Sheets

OVEN APPLIANCE AND A METHOD FOR OPERATING AN OVEN APPLIANCE

FIELD OF THE INVENTION

The subject matter of the present disclosure relates generally to an oven appliance and a method for operating an oven appliance to preheat the oven cavity.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, bottom portion, or both of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

During a typical preheat cycle, the air and surfaces of the cooking chamber are heated to a set temperature. The time required to heat the cooking chamber to the set temperature may vary depending on the load of the cooking chamber, i.e., additional baking racks, the type and/or number of cooking utensils, or the like within the cooking chamber during the preheat cycle can lengthen the preheat cycle because these objects must also be heated to achieve the set temperature. Further, the heat balance within the cooking chamber following the preheat cycle may vary based on the load of the cooking chamber such that food items cook differently based on the load of the cooking chamber. Increasing airflow within the cooking chamber may promote heat transfer and distribute heat within the cooking chamber, but acoustic noise produced by operating one or more fans for a longer period of time or at a higher speed may be undesired.

Accordingly, an oven appliance with features for minimizing the preheat time and balancing the heat distribution within the cooking chamber of the oven appliance while minimizing acoustic noise would be useful. Further, a method for operating an oven appliance to minimize the preheat time and balance the heat distribution within the cooking chamber of the oven appliance while minimizing acoustic noise would be beneficial.

BRIEF DESCRIPTION OF THE INVENTION

The present invention provides an oven appliance with one or more features for minimizing the time to preheat the cooking chamber and balancing the heat distribution within the cooking chamber of the oven appliance. Features for minimizing the acoustic noise of the oven appliance are also provided. Further, a method for operating an oven appliance to minimize the preheat time and balance the heat distribution within the cooking chamber of the oven appliance while minimizing acoustic noise is provided. Additional aspects and advantages of the invention will be set forth in part in the following description, may be apparent from the description, or may be learned through practice of the invention.

In a first exemplary embodiment, a method for operating an oven appliance is provided. The oven appliance includes a cooking chamber for receipt of food items for cooking. The method includes the steps of establishing a cook mode of the oven appliance; measuring a temperature $T_{initial}$; initiating a preheat cycle of the oven appliance; counting a time $t_{pre}$; determining whether time $t_{pre}$ has reached a threshold time $t_{thr}$ and, if so, then measuring a temperature $T_{thr}$; determining whether the cooking chamber of the oven appliance is heavily loaded and, if so, then increasing convection airflow within the cooking chamber.

In a second exemplary embodiment, a method for operating an oven appliance is provided. The oven appliance includes a cooking chamber for receipt of food items for cooking. The method includes the steps of establishing a cook mode of the oven appliance; measuring a temperature $T_{initial}$; initiating a preheat cycle of the oven appliance; counting a time $t_{pre}$; measuring a temperature $T_{pre}$; determining whether the difference between temperature $T_{pre}$ and temperature $T_{intital}$ is at least a value $T_{base}$ and, if so, then recording a time $t_{thr}$; determining whether the cooking chamber of the oven appliance is heavily loaded and, if so, then increasing convection airflow within the cooking chamber.

In a third exemplary embodiment, an oven appliance is provided. The oven appliance includes a cabinet defining a cooking chamber configured for receipt of food items for cooking; a heating element configured to heat the cooking chamber; a fan; and a controller in operative communication with the heating element and the fan. The controller is configured for establishing a cook mode of the oven appliance; measuring a temperature $T_{initial}$; initiating a preheat cycle of the oven appliance;

counting a time $t_{pre}$; determining whether time $t_{pre}$ has reached a threshold time $t_{thr}$ and, if so, then measuring a temperature $T_{thr}$; determining whether the cooking chamber of the oven appliance is heavily loaded and, if so, then increasing convection airflow within the cooking chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
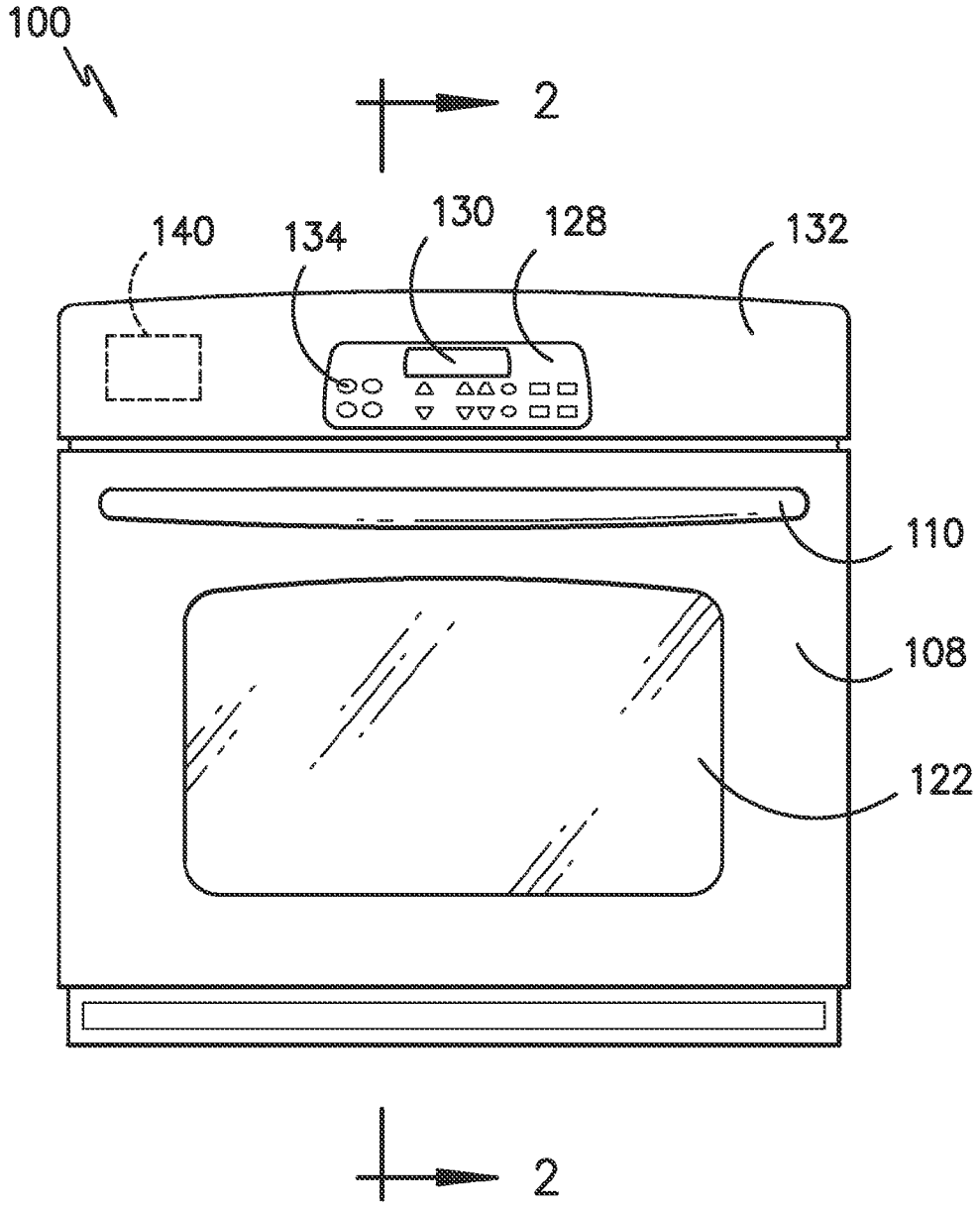
FIG. 1 provides a front view of an exemplary embodiment of an oven appliance of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
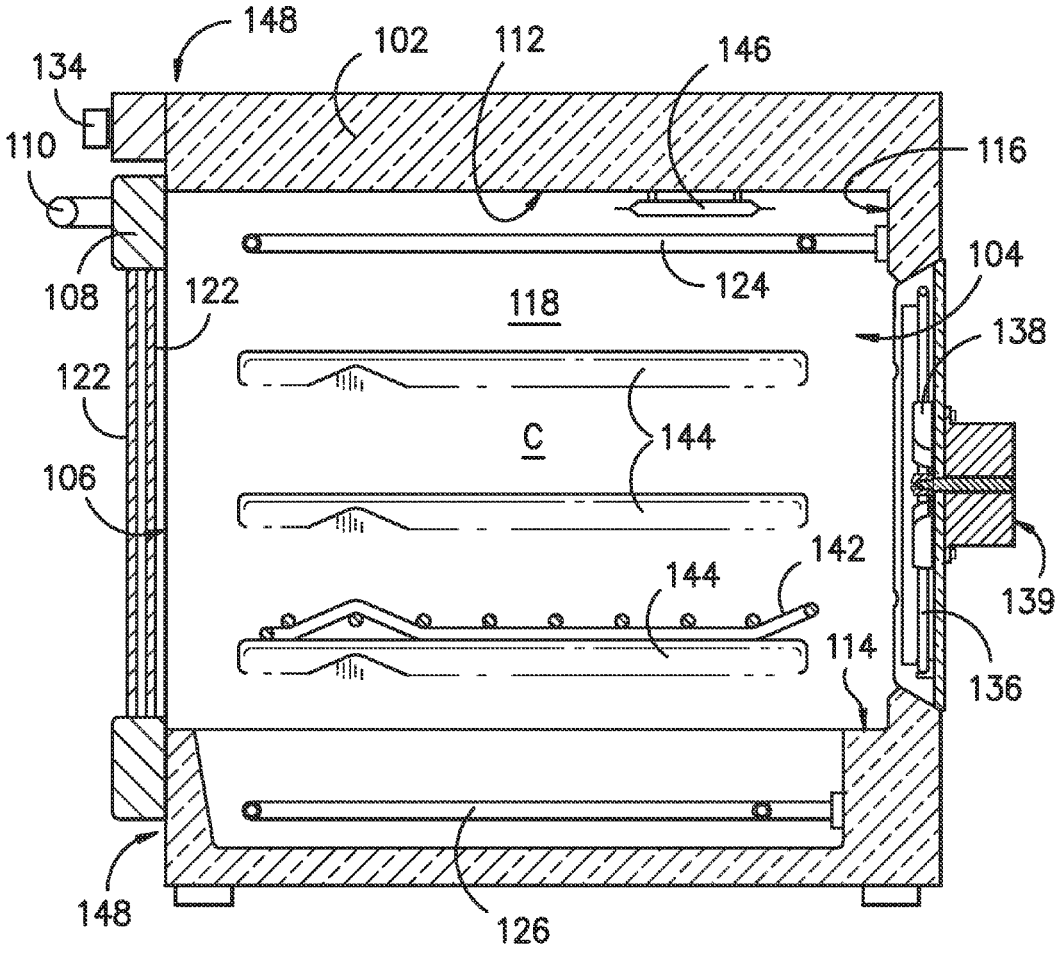
FIG. 2 is a cross-sectional view of the oven appliance of FIG. 1 taken along the 2-2 line of FIG. 1.

Referring to FIGS. 1 and 2, for this exemplary embodiment, oven appliance 100 includes an insulated cabinet 102 with an interior cooking chamber 104 defined by a top wall 112, a bottom wall 114, a back wall 116, and opposing side walls 118, 120. Cooking chamber 104 is configured for the receipt of one or more food items to be cooked. Oven appliance 100 includes a door 108 pivotally mounted, e.g., with one or more hinges (not shown), to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking fumes within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

A heating element at the top, bottom, or both of cooking chamber 104 provides heat to cooking chamber 104 for cooking. Such heating element(s) can be gas, electric, microwave, or a combination thereof. For example, in the embodiment shown in FIG. 2, oven appliance 100 includes a top heating element 124 and a bottom heating element 126, where bottom heating element 126 is positioned adjacent to and below bottom wall 114. Other configurations with or without wall 114 may be used as well.

Oven appliance 100 also has a convection heating element 136 and convection fan 138 positioned adjacent back wall 116 of cooking chamber 104. Convection fan 138 is powered by a convection fan motor 139. Further, convection fan 138 can be a variable speed fan—meaning the speed of fan 138 may be controlled or set anywhere between and including, e.g., 0 and 100 percent. The speed of convection fan 138 can be determined by, and communicated to, fan 138 by controller 140.

Oven appliance 100 includes a user interface 128 having a display 130 positioned on an interface panel 132 and having a variety of controls 134. Interface 128 allows the user to select various options for the operation of oven 100 including, e.g., temperature, time, and/or various cooking and cleaning cycles. Operation of oven appliance 100 can be regulated by a controller 140 that is operatively coupled, i.e., in communication with, user interface 128, heating elements 124, 126, and other components of oven 100 as will be further described.

For example, in response to user manipulation of the user interface 128, controller 140 can operate the heating element(s). Controller 140 can receive measurements from a temperature sensor 146 placed in cooking chamber 104 and, e.g., provide a temperature indication to the user with display 130. Controller 140 can also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128 otherwise within interface panel 132 or at any other appropriate location with respect to oven appliance 100. In the embodiment illustrated in FIG. 1, input/output ("I/O") signals are routed between controller 140 and various operational components of oven appliance 100 such as heating elements 124, 126, 136, convection fan 138, controls 134, display 130, sensor 146, alarms, and/or other components as may be provided. In one embodiment, user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens.

Oven appliance 100 may have several cooking and cleaning cycles, including a preheat cycle. Generally, the preheat cycle ensures the cooking chamber is thermally "soaked," such that the air temperature in the center of the cooking chamber has reached the cooking temperature and the surfaces of the cooking chamber are heated to a temperature for radiation heat transfer from the surfaces. However, when cooking chamber 104 is heavily loaded, e.g., with a pizza stone or several baking racks 142, more time is required to preheat cooking chamber 104 and a different heat balance is achieved than when cooking chamber 104 has a lesser load. Improved preheating time and cooking performance may be gained by increasing the airflow within cooking chamber 104 using, e.g., convection fan 138. However, increasing the airflow by, e.g., increasing the speed of fan 138 or increasing the duty cycle of fan 138, together with or separately from convection heating element 136, can yield more acoustic noise, which could be undesirable to a user of oven appliance 100.

In any event, oven appliance 100 may include several features to shorten the time required to preheat cooking chamber 104 and to improve cooking performance of a heavily loaded oven while maintaining lower acoustic noise for an unloaded oven. As an example, methods of operating oven appliance 100 may detect that cooking chamber 104 is heavily loaded and utilize the convection heating element and fan to increase the convection airflow during the preheat cycle to properly heat soak cooking chamber 104 in a shortened period of time. As a further example, methods of operating oven appliance 100 may detect that cooking chamber 104 is heavily loaded and provide a notification to the user, e.g., to expect a longer preheat cycle or different cooking conditions. Such features and methods of operating oven appliance 100 will be further described below.

Figure 3:
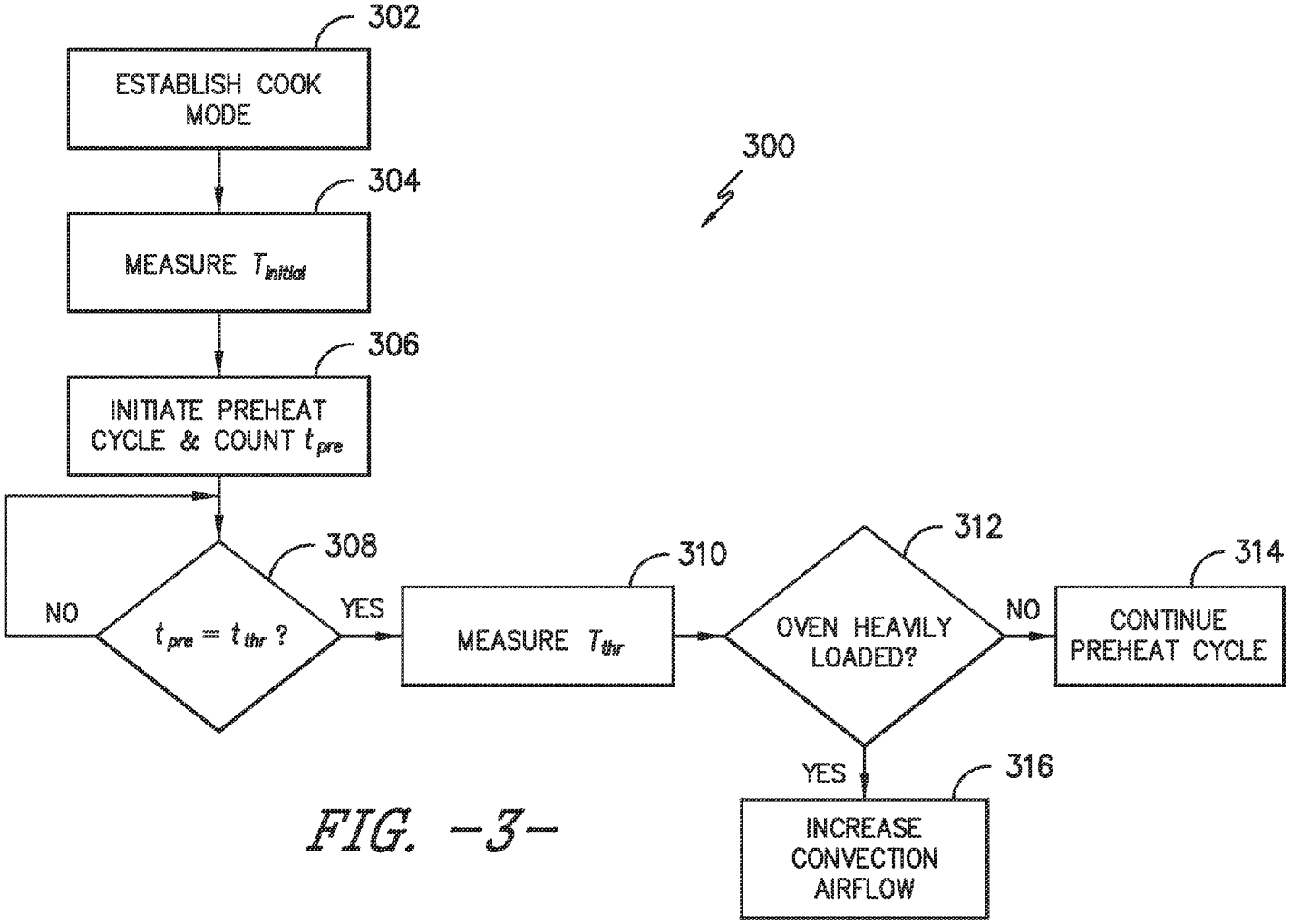
FIG. 3 provides a chart illustrating an exemplary method for operating an oven appliance according to the present subject matter.

FIG. 3 illustrates an exemplary method of operating oven appliance 100. Method 300 may be performed in whole or in part by controller 140 or any other suitable device or devices. At step 302, a cook mode of oven appliance 100 is established. In one embodiment, a user of oven appliance 100 may use, e.g., controls 134, to select a bake, broil, or convection cycle as the cook mode of oven appliance 100. The manipulation of controls 134 may generate a signal that is processed by controller 140 to establish the cook mode selected by the user. Other ways of establishing a cook mode may be used as well. Additionally, other parameters of the cooking cycle such as, e.g., cooking temperature and/or cooking time may be selected and set when the cook mode is established at step 302.

After the cook mode is established, at step 304 the temperature of cooking chamber 104 may be measured and stored as a temperature $T_{initial}$. Temperature $T_{inital}$ may be measured or sensed using, e.g., temperature sensor 146 and may be stored in, e.g., controller 140. At step 306, a preheat cycle of oven appliance 100 is initiated, and controller 140 may begin counting a time $t_{pre}$, such that time $t_{pre}$ may represent the time elapsed since the preheat cycle was initiated. Initiating a preheat cycle may include activating one or more heating elements of oven appliance 100; convection fan 138 may also be activated as part of initiating a preheat cycle. Fan 138 may be operated constantly or may be operated in a duty cycle, i.e., cycled between being on for a period of time and being off for a period of time. Further, during the preheat cycle, fan 138 may be operated with or without operating convection heating element 136. Other fans and other ways of operating the one or more fans and the heating elements during the preheat cycle may also be used.

At step 308, controller 140 determines whether time $t_{pre}$ has reached a threshold time $t_{thr}$. If not, controller 140 continues to count time $t_{pre}$. However, if time $t_{pre}$ has reached threshold time $t_{thr}$, method 300 includes step 310 of measuring a temperature $T_{thr}$. Accordingly, temperature $T_{thr}$ may represent the temperature of cooking chamber 104 at threshold time $t_{thr}$, i.e., the temperature reached in cooking chamber 104 after time $t_{thr}$ has elapsed since the preheat cycle was initiated.

Figure 4:
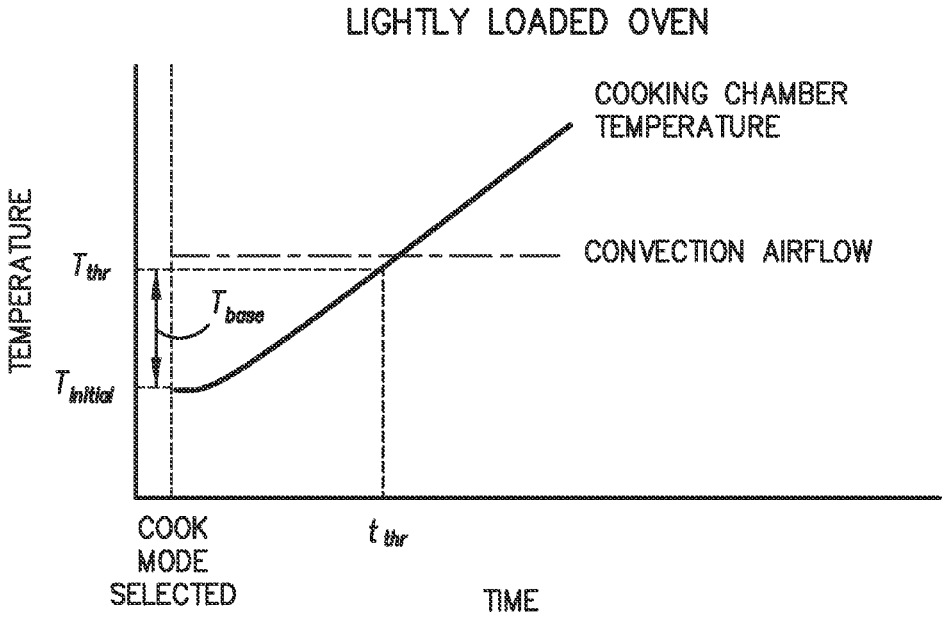
FIG. 4 provides a graph of cooking chamber temperatures and convection airflow in accordance with one embodiment of the present subject matter.
Figure 5:
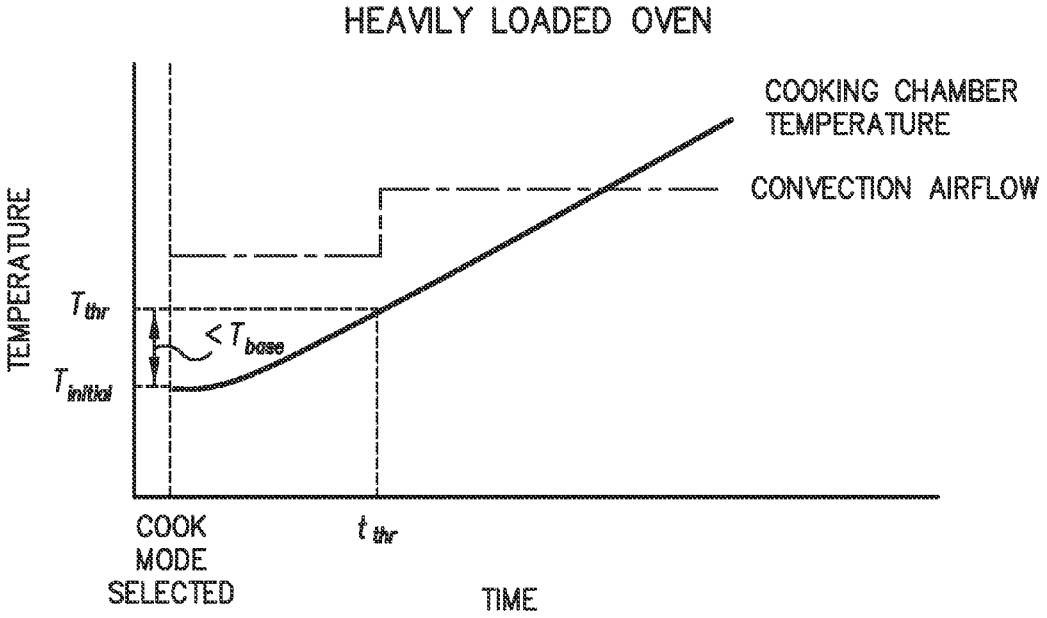
FIG. 5 provides a graph of cooking chamber temperatures and convection airflow in accordance with another embodiment of the present subject matter.

At step 312, controller 140 determines whether cooking chamber 104 is heavily loaded. As illustrated in FIGS. 4 and 5, cooking chamber 104 may be determined to be heavily loaded if the difference between temperature $T_{thr}$ and temperature $T_{initial}$ is less than a value $T_{base}$. The value $T_{base}$ may represent a difference or gap between the initial temperature $T_{initial}$ of cooking chamber 104 and the temperature $T_{thr}$ at threshold time $t_{thr}$ that is a typical gap between initial and threshold temperatures when cooking chamber 104 is preheating without a heavy load. That is, if cooking chamber 104 is not heavily loaded, when the preheating cycle has been operating for time $t_{thr}$, the air within cooking chamber 104 should have been heated to a sufficient temperature such that the difference between the initial temperature of cooking chamber 104 and the temperature at time $t_{thr}$ is at least $T_{base}$.

The value $T_{base}$ may be determined, e.g., experimentally and programmed into controller 140 as a predetermined value used during each iteration of method 300. In one exemplary experiment, the temperature of a lightly loaded oven, e.g., a cooking chamber containing one baking rack, during a preheat cycle was recorded over a period of approximately 700 seconds. The initial temperature of the cooking chamber of the lightly loaded oven was approximately 72° F. At a threshold time of 400 seconds, the cooking chamber temperature was approximately 196° F. As a result of this exemplary experiment, $T_{base}$ could be established as about 124° F., the difference between the initial temperature of the cooking chamber and the temperature of the cooking chamber at the threshold time of 400 seconds. Thus, for an oven appliance employing a value $T_{base}$ of about 124° F., if the difference between the initial temperature of the cooking chamber and the temperature of the cooking chamber at 400 seconds was not at least 124° F., then the controller could conclude that the cooking chamber was heavily loaded.

Alternatively, a nominal value of $T_{base}$ and one or more transfer functions may be determined, e.g., experimentally and programmed into controller 140 such that the value $T_{base}$ may be adjusted based on parameters such as, e.g., the established cook mode, the set cooking temperature, the initial temperature $T_{initial}$, the power or current draw by oven appliance 100 and/or heating elements 124, 126, 136, the supply voltage to oven appliance 100 and/or heating elements 124, 126, 136, and the temperature history of cooking chamber 104. Thus, in some embodiments, the value $T_{base}$ may vary after several iterations of method 300 or from one iteration of method 300 to another.

If cooking chamber 104 is determined to not be heavily loaded, i.e., cooking chamber 104 is lightly loaded, method 300 proceeds to step 314, and the preheat cycle continues without change. For example, as illustrated in FIG. 4, if convection fan 138 is being operated at a certain speed or duty cycle, or if fan 138 is not being operated, the speed or duty cycle of fan 138 is not altered if cooking chamber 104 is found to be lightly loaded. However, if cooking chamber 104 is determined to be heavily loaded, method 300 includes step 316 of increasing the convection airflow within cooking chamber 104, as illustrated in FIG. 5. The convection airflow may be increased, e.g., by increasing the speed of convection fan 138. For example, if convection fan 138 may be operated at 50 percent speed prior to step 312, and if at step 312 it is determined that the convection airflow should be increased, controller 140 may increase the speed of convection fan 138 to 75 percent speed. Alternatively, the convection airflow may be increased by increasing the duty cycle of convection fan 138. For example, if prior to step 614 convection fan 138 was operated in a duty cycle such that fan 138 was repeatedly switched on for 30 seconds then off for 30 seconds over a given period of time, if it is determined that the convection airflow should be increased, the duty cycle may be modified such that fan 138 is on for 45 seconds then off for 15 seconds. As an additional example, if prior to step 614 convection heating element 136 was operated in a duty cycle such that convection heating element was cycled on for 30 seconds and then off for 30 seconds while fan 138 was operated at a constant speed, the duty cycle may be modified such that convection heating element 136 is cycled on for 45 seconds then off for 15 seconds while fan 138 is operated at a constant speed. Other values of increased fan speed and duty cycle may be used, and other ways of increasing convection airflow may be used as well.

Figure 6:
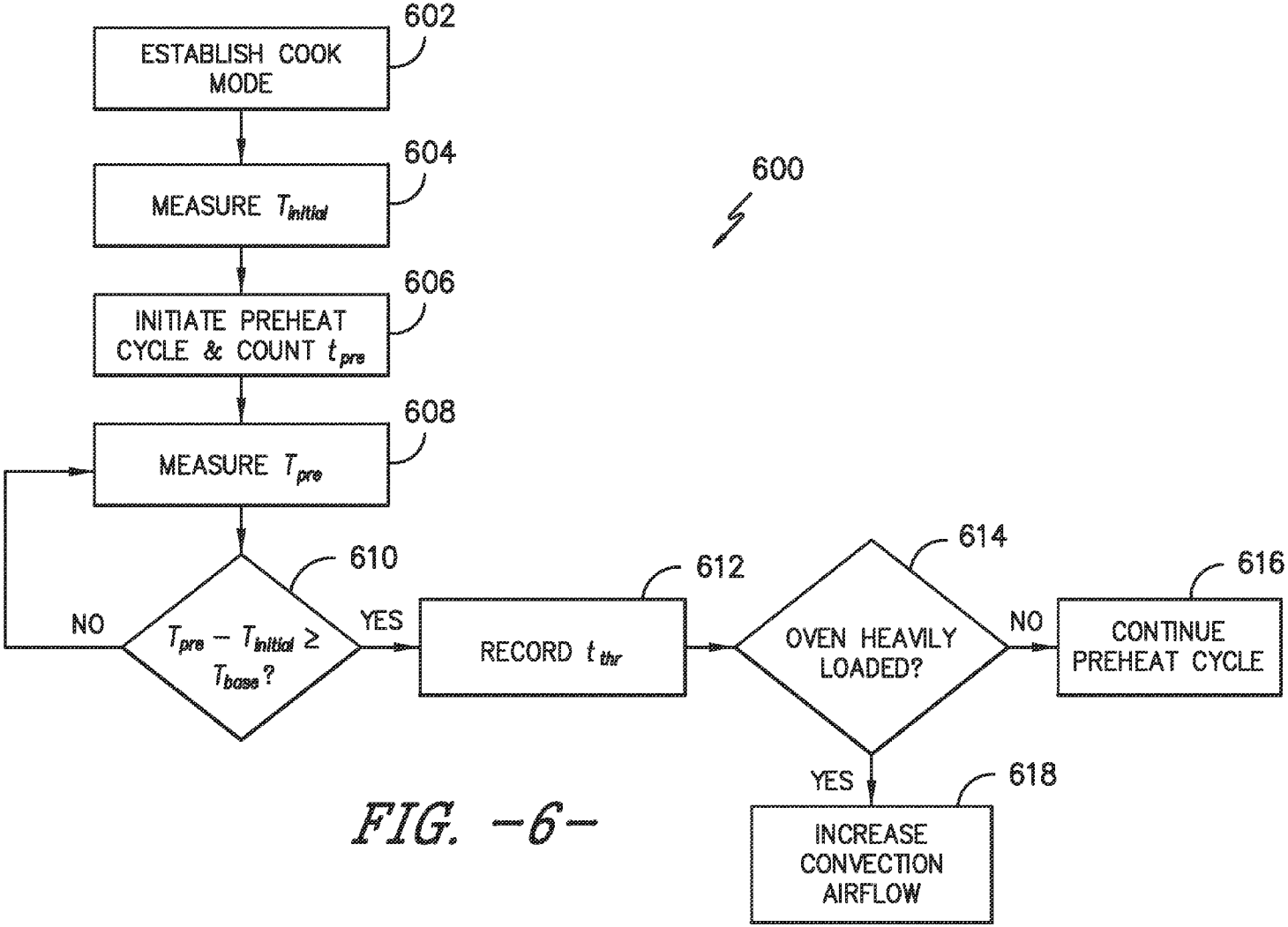
FIG. 6 provides a chart illustrating another exemplary method for operating an oven appliance according to the present subject matter.

FIG. 6 illustrates another exemplary method of operating oven appliance 100. Method 600 may be performed in whole or in part by controller 140 or any other suitable device or devices. At step 602, a cook mode of oven appliance 100 is established. In one embodiment, a user of oven appliance 100 may use, e.g., controls 134, to select a bake, broil, or convection cycle as the cook mode of oven appliance 100. The manipulation of controls 134 may generate a signal that is processed by controller 140 to establish the cook mode selected by the user. Other ways of establishing a cook mode may be used as well. Additionally, other parameters of the cooking cycle such as, e.g., cooking temperature and/or cooking time may be selected and set when the cook mode is established at step 602.

After the cook mode is established, at step 604 the temperature of cooking chamber 104 may be measured and stored as a temperature $T_{initial}$. Temperature $T_{initial}$ may be measured or sensed using, e.g., temperature sensor 146 and may be stored in, e.g., controller 140. At step 606, a preheat cycle of oven appliance 100 is initiated, and controller 140 may begin counting a time $t_{pre}$, such that time $t_{pre}$ may represent the time elapsed since the preheat cycle was initiated. Initiating a preheat cycle may include activating one or more heating elements of oven appliance 100; convection fan 138 may also be activated as part of initiating a preheat cycle. Fan 138 may be operated constantly or may be operated in a duty cycle, i.e., cycled between being on for a period of time and being off for a period of time. Further, during the preheat cycle, fan 138 may be operated with or without operating convection heating element 136. Other fans and other ways of operating the one or more fans and the heating elements during the preheat cycle may be used as well.

As shown at step 608, controller 140 measures or senses a temperature $T_{pre}$ in cooking chamber 104 using, e.g., temperature sensor 146. At step 610, controller 140 determines whether the difference between temperature $T_{pre}$ and temperature $T_{initial}$ is at least a value $T_{base}$. If not, controller 140 continues to measure temperature $T_{pre}$ and determine whether the difference between temperature $T_{pre}$ and temperature $T_{initial}$ is at least $T_{base}$. However, if the difference between temperature $T_{pre}$ and temperature $T_{initial}$ is at least $T_{base}$, method 600 includes step 612, where a time $t_{thr}$ is recorded. Thus, time $t_{thr}$ is the time $t_{pre}$ elapsed since the preheat cycle was initiated to heat cooking chamber 104 to a temperature $T_{pre}$ such that the difference between temperature $T_{pre}$ and $T_{initial}$ is at least $T_{base}$.

As described above, the value $T_{base}$ may represent a difference or gap between the initial temperature $T_{initial}$ of cooking chamber 104 and the temperature $T_{thr}$ at threshold time $t_{thr}$ that is a typical gap between initial and threshold temperatures when cooking chamber 104 is preheating without a heavy load. That is, if cooking chamber 104 is not heavily loaded, when the preheating cycle has been operating for time $t_{thr}$, the air within cooking chamber 104 should have been heated to a sufficient temperature such that the difference between the initial temperature of cooking chamber 104 and the temperature at time $t_{thr}$ is at least $T_{base}$.

The value $T_{base}$ may be determined, e.g., experimentally and programmed into controller 140 as a predetermined value used during each iteration of method 300. As described above, in some embodiments, $T_{base}$ may be about 124° F. such that, for oven appliance 100 employing a value $T_{base}$ of about 124° F., if the difference between the initial temperature of the cooking chamber and the temperature of the cooking chamber at 400 seconds was not at least 124° F., then the controller could conclude that the cooking chamber was heavily loaded. Alternatively, a nominal value of $T_{base}$ and one or more transfer functions may be determined, e.g., experimentally and programmed into controller 140 such that the value $T_{base}$ may be adjusted based on parameters such as, e.g., the established cook mode, the set cooking temperature, the initial temperature $T_{initial}$, the power or current draw by oven appliance 100 and/or heating elements 124, 126, 136, the supply voltage to oven appliance 100 and/or heating elements 124, 126, 136, and the temperature history of cooking chamber 104. Thus, in some embodiments, the value $T_{base}$ may vary after several iterations of method 600 or from one iteration of method 600 to another.

Figure 7:
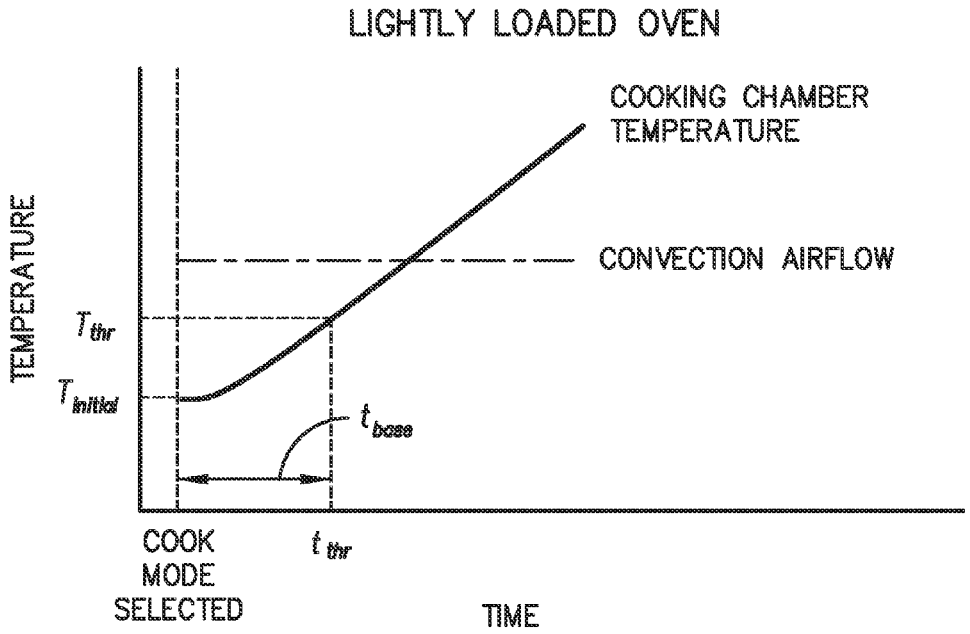
FIG. 7 provides a graph of cooking chamber temperatures and convection airflow in accordance with an embodiment of the present subject matter.
Figure 8:
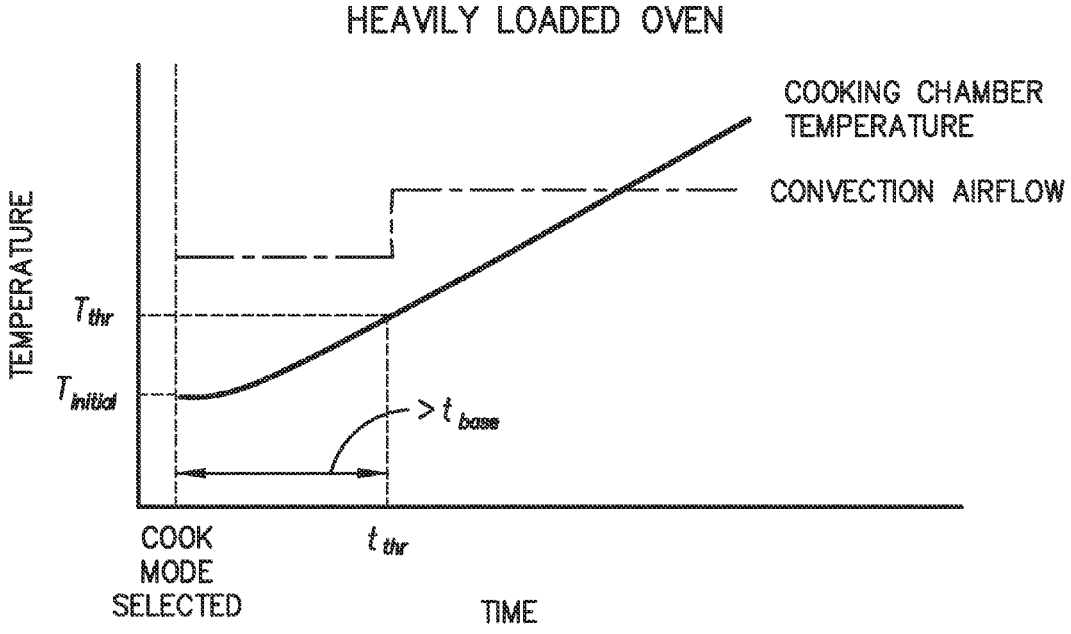
FIG. 8 provides a graph of cooking chamber temperatures and convection airflow in accordance with another embodiment of the present subject matter.

After recording time $t_{thr}$, method 600 proceeds to step 614, where controller 140 determines whether cooking chamber 104 is heavily loaded. As illustrated in FIGS. 7 and 8, cooking chamber 104 may be determined to be heavily loaded if time $t_{thr}$ is greater than a time $t_{base}$. Time $t_{base}$ may represent the time required to reach at least a threshold temperature $T_{thr}$ when cooking chamber 104 is preheating without a heavy load, where threshold temperature $T_{thr}$ is equal to $T_{initial}$ plus $T_{base}$, that is, a temperature greater than $T_{initial}$ by the value $T_{base}$. Thus, as shown in FIG. 7, if time $t_{thr}$ equals or is less than time $t_{base}$, controller 140 may determine that cooking chamber 104 is lightly loaded. Likewise, as FIG. 8 illustrates, if time $t_{thr}$ exceeds time $t_{base}$, such that a longer time was required to heat cooking chamber 104 to threshold temperature $T_{thr}$, then controller 140 may determine that cooking chamber 104 is heavily loaded.

If cooking chamber 104 is determined to not be heavily loaded, i.e., cooking chamber 104 is lightly loaded, method 600 proceeds to step 616, and the preheat cycle continues without change. For example, as illustrated in FIG. 7, if convection fan 138 is being operated at a certain speed or duty cycle, or if fan 138 is not being operated, the speed or duty cycle of fan 138 is not altered if cooking chamber 104 is found to be lightly loaded. However, if cooking chamber 104 is determined to be heavily loaded, method 600 includes step 618 of increasing the convection airflow within cooking chamber 104, as illustrated in FIG. 8. The convection airflow may be increased, e.g., by increasing the speed of convection fan 138. For example, if convection fan 138 may be operated at 50 percent speed prior to step 614, and if at step 614 it is determined that the convection airflow should be increased, controller 140 may increase the speed of convection fan 138 to 75 percent speed. Alternatively, the convection airflow may be increased by increasing the duty cycle of convection fan 138 and/or one or more heating elements 124, 126, 136. For example, if prior to step 614 convection fan 138 was operated in a duty cycle such that fan 138 was repeatedly switched on for 30 seconds then off for 30 seconds over a given period of time, if it is determined that the convection airflow should be increased, the duty cycle may be modified such that fan 138 is on for 45 seconds then off for 15 seconds. As an additional example, if prior to step 614 convection heating element 136 was operated in a duty cycle such that convection heating element was cycled on for 30 seconds and then off for 30 seconds while fan 138 was operated at a constant speed, the duty cycle may be modified such that convection heating element 136 is cycled on for 45 seconds then off for 15 seconds while fan 138 is operated at a constant speed. Other values of increased fan speed and duty cycle may be used, and other ways of increasing convection airflow may be used as well.

As previously stated, a heavily loaded oven or cooking chamber will take longer to preheat and will yield a different heat balance after preheating, which information could be beneficial to a user of the oven appliance. For example, when cooking chamber 104 is heavily loaded, food items placed therein may cook or brown faster on a side of the food item, or cooking utensil in which the food item is placed, closest to bottom wall 114 and bake heating element 126. If the user was informed of this condition, the user may, e.g., place food items further away from bottom wall 114 and bake heating element 126, adjust the cooking temperature, or adjust the cooking time. Other conditions also could alter how the user utilizes oven appliance 100 and, thus, information about such conditions could be valuable to the user.

Figure 9:
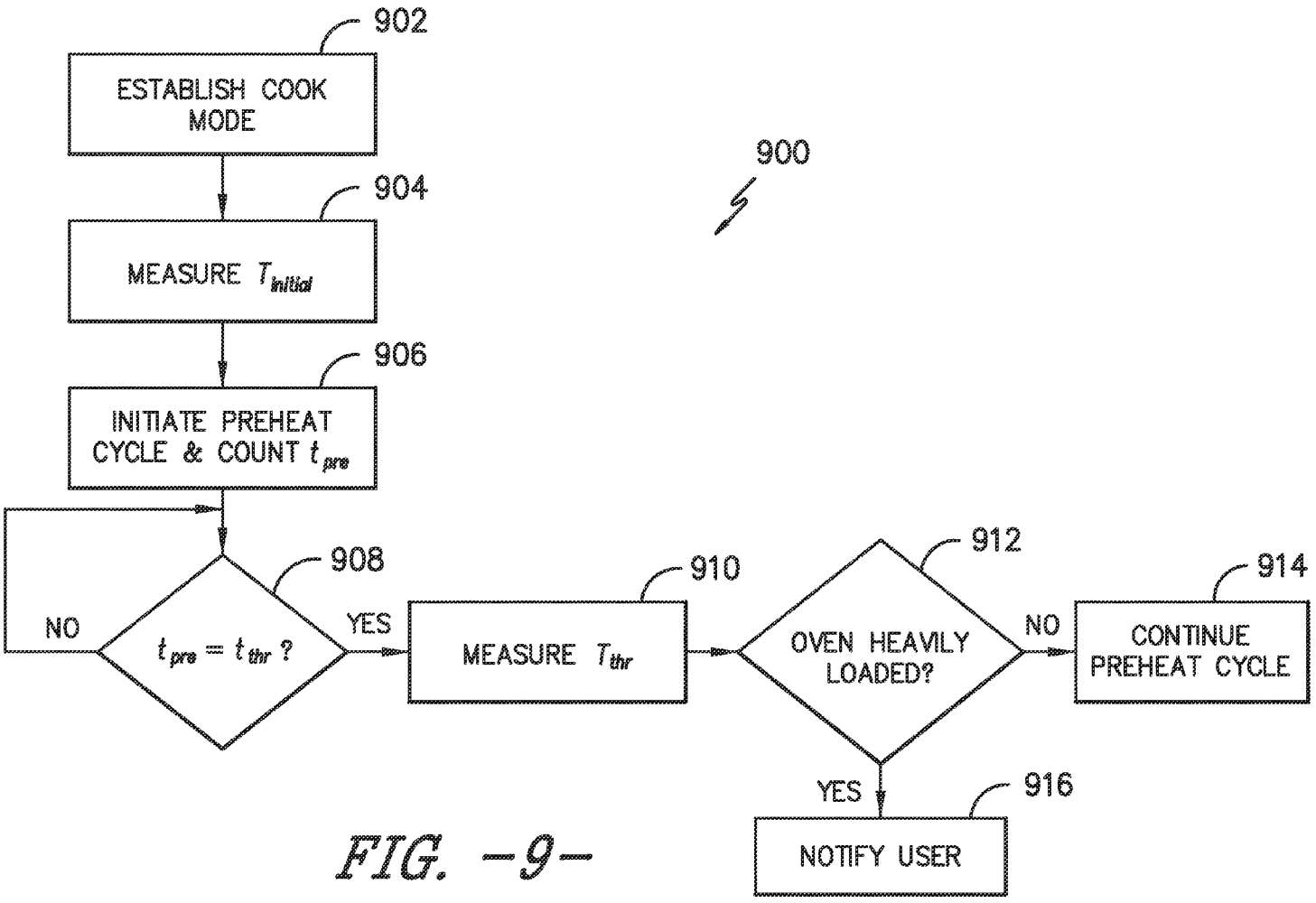
FIG. 9 provides a chart illustrating another exemplary method for operating an oven appliance according to the present subject matter.

Accordingly, oven appliance 100 may include features for providing information to a user about the operation of oven 100 when cooking chamber 104 is heavily loaded, and FIG. 9 illustrates an exemplary method of operating oven appliance 100. Method 900 may be performed in whole or in part by controller 140 or any other suitable device or devices. At step 902, a cook mode of oven appliance 100 is established. In one embodiment, a user of oven appliance 100 may use, e.g., controls 134, to select a bake, broil, or convection cycle as the cook mode of oven appliance 100. The manipulation of controls 134 may generate a signal that is processed by controller 140 to establish the cook mode selected by the user. Other ways of establishing a cook mode may be used as well. Additionally, other parameters of the cooking cycle such as, e.g., cooking temperature and/or cooking time may be selected and set when the cook mode is established at step 902.

After the cook mode is established, at step 904 the temperature of cooking chamber 104 may be measured and stored as a temperature $T_{initial}$. Temperature $T_{initial}$ may be measured or sensed using, e.g., temperature sensor 146 and may be stored in, e.g., controller 140. At step 906, a preheat cycle of oven appliance 100 is initiated, and controller 140 may begin counting a time $t_{pre}$, such that time $t_{pre}$ may represent the time elapsed since the preheat cycle was initiated. As previously described, initiating a preheat cycle may include activating one or more heating elements of oven appliance 100; one or more fans, such as convection fan 138, may also be activated and operated as described.

At step 908, controller 140 determines whether time $t_{pre}$ has reached a threshold time $t_{thr}$. If not, controller 140 continues to count time $t_{pre}$. However, if time $t_{pre}$ has reached threshold time $t_{thr}$, method 900 includes step 910 of measuring a temperature $T_{thr}$. Accordingly, temperature $T_{thr}$ may represent the temperature of cooking chamber 104 at threshold time $t_{thr}$, i.e., the temperature reached in cooking chamber 104 after time $t_{thr}$ has elapsed since the preheat cycle was initiated.

At step 912, controller 140 determines whether cooking chamber 104 is heavily loaded. As illustrated in FIGS. 4 and 5, cooking chamber 104 may be determined to be heavily loaded if the difference between temperature $T_{thr}$ and temperature $T_{initial}$ is less than a value $T_{base}$. The value $T_{base}$ may represent a difference or gap between the initial temperature $T_{initial}$ of cooking chamber 104 and the temperature $T_{thr}$ at threshold time $t_{thr}$ that is a typical gap between initial and threshold temperatures when cooking chamber 104 is preheating without a heavy load. That is, if cooking chamber 104 is not heavily loaded, when the preheating cycle has been operating for time $t_{thr}$, the air within cooking chamber 104 should have been heated to a sufficient temperature such that the difference between the initial temperature of cooking chamber 104 and the temperature at time $t_{thr}$ is at least $T_{base}$.

The value $T_{base}$ may be determined, e.g., experimentally and programmed into controller 140 as a predetermined value used during each iteration of method 300. As previously described, in some embodiments, $T_{base}$ may be about 124° F. such that, for oven appliance 100 employing a value $T_{base}$ of 124° F., if the difference between the initial temperature of the cooking chamber and the temperature of the cooking chamber at 400 seconds was not at least 124° F., then the controller could conclude that the cooking chamber was heavily loaded. Alternatively, a nominal value of $T_{base}$ and one or more transfer functions may be determined, e.g., experimentally and programmed into controller 140. Then, using the one or more transfer functions, the value $T_{base}$ may be adjusted based on parameters such as, e.g., the established cook mode, the set cooking temperature, the initial temperature $T_{initial}$, the power or current draw by oven appliance 100 and/or heating elements 124, 126, 136, the supply voltage to oven appliance 100 and/or heating elements 124, 126, 136, and the temperature history of cooking chamber 104. Thus, in some embodiments, the value $T_{base}$ may vary after several iterations of method 900 or from one iteration of method 900 to another.

If cooking chamber 104 is determined to not be heavily loaded, i.e., cooking chamber 104 is lightly loaded, method 900 proceeds to step 914, and the preheat cycle continues without change. However, if cooking chamber 104 is determined to be heavily loaded, method 900 includes step 916 of notifying the user that cooking chamber 104 is heavily loaded, e.g., by notifying the user of one or more conditions that result from cooking chamber 104 being heavily loaded. The notification may be any audible and/or visual signal that indicates to the user that one or more conditions, such as, e.g., a longer preheat cycle, should be expected. By way of example, the notification may be text displayed on user interface 128, a verbal phrase, an LED light, and/or a buzzer. The user may also be notified via a wireless communication from oven appliance 100 to a mobile device, such as a cellular telephone, tablet, or laptop computer, and the notification may be, e.g., text and/or graphics displayed on the user's mobile device and/or an audible notification emitted through the user's mobile device. In other embodiments, the notification may be any other appropriate visual and/or audible signal.

As an example of a condition that may warrant a notification, if cooking chamber 104 is heavily loaded, the preheat cycle may be longer than the preheat cycle of a lightly loaded oven. Thus, a notification may be provided to the user through, e.g., a visual or audible signal, that the preheat cycle will be of a longer or an extended duration. Further, in some embodiments of oven appliance 100, if cooking chamber 104 is heavily loaded, cooking chamber 104 may have a different heat balance during the cooking cycle such that food items placed therein cook or brown faster in certain areas that in others. For example, food items or portions of food items closer to top wall 112 may cook or brown faster than food items or portions of food items that are further away from top wall 112. Accordingly, controller 140 may provide a notification that excessive cooking or browning can be expected for food items placed near top wall 112. It should also be appreciated that controller 140 may provide a notification to the user if cooking chamber 104 is lightly loaded, e.g., a lighted LED next to the text "Normal Preheat" may provide a notification that the preheat cycle will not be longer than usual. Other notifications, providing information about other conditions that may result when cooking chamber 104 is lightly or heavily loaded, may also be provided.

Figure 10:
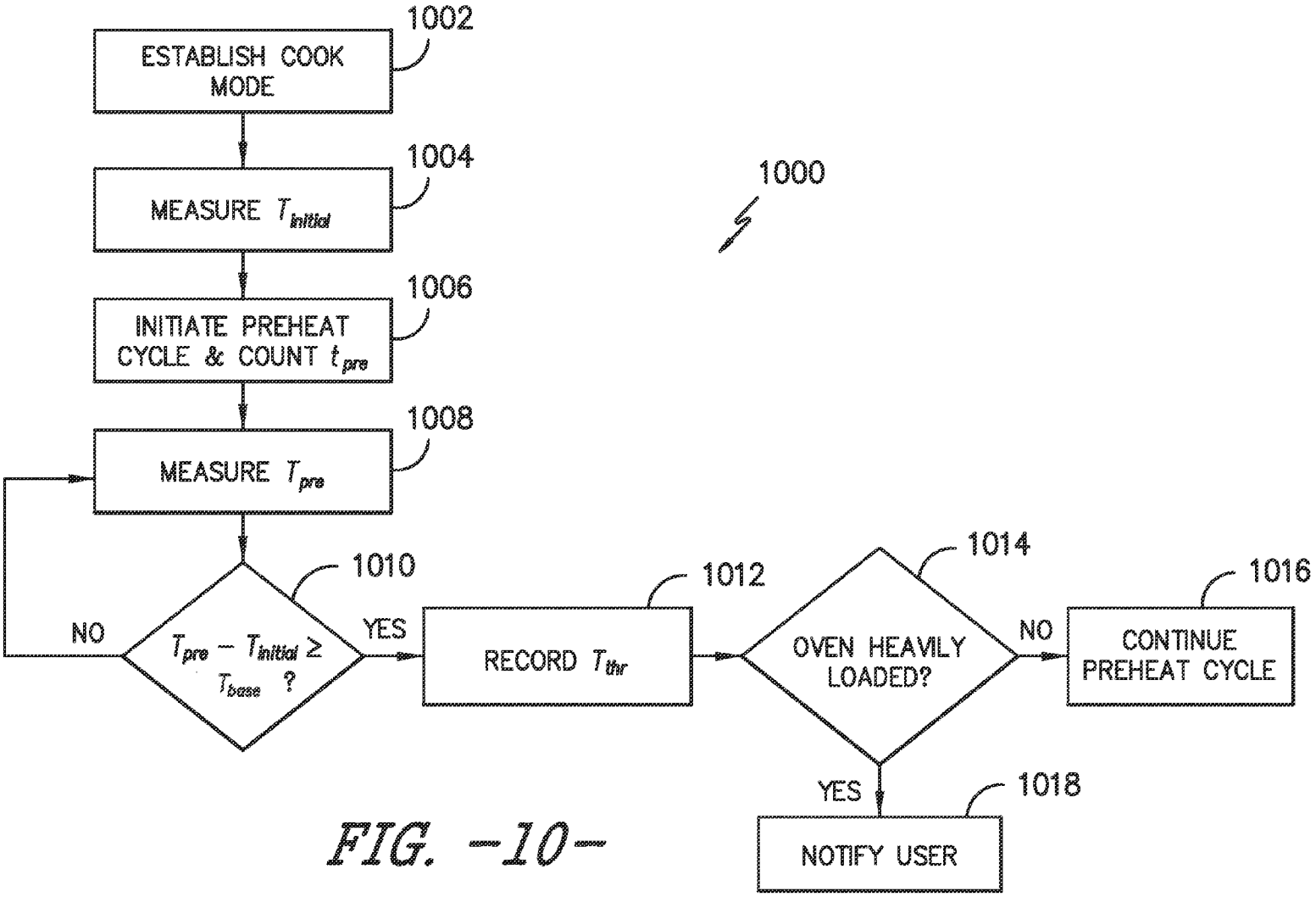
FIG. 10 provides a chart illustrating another exemplary method for operating an oven appliance according to the present subject matter.

FIG. 10 illustrates another exemplary method of operating oven appliance 100. Method 1000 may be performed in whole or in part by controller 140 or any other suitable device or devices. At step 1002, a cook mode of oven appliance 100 is established. In some embodiments, a user of oven appliance 100 may use, e.g., controls 134, to select a bake, broil, or convection cycle as the cook mode of oven appliance 100. The manipulation of controls 134 may generate a signal that is processed by controller 140 to establish the cook mode selected by the user. Other ways of establishing a cook mode may be used as well. Additionally, other parameters of the cooking cycle such as, e.g., cooking temperature and/or cooking time may be selected and set when the cook mode is established at step 1002.

After the cook mode is established, at step 1004 the temperature of cooking chamber 104 may be measured and stored as a temperature $T_{initial}$. Temperature $T_{initial}$ may be measured or sensed using, e.g., temperature sensor 146 and may be stored in, e.g., controller 140. At step 1006, a preheat cycle of oven appliance 100 is initiated, and controller 140 may begin counting a time $t_{pre}$, such that time $t_{pre}$ may represent the time elapsed since the preheat cycle was initiated. As previously described, initiating a preheat cycle may include activating one or more heating elements of oven appliance 100; one or more fans, such as convection fan 138, may also be activated and operated as described.

At step 1010, controller 140 determines whether the difference between temperature $T_{pre}$ and temperature $T_{initial}$ is at least a value $T_{base}$. If not, controller 140 continues to measure temperature Tpre and determine whether the difference between temperature $T_{pre}$ and temperature $T_{initial}$ is at least $T_{base}$. However, if the difference between temperature $T_{pre}$ and temperature $T_{initial}$ is at least $T_{base}$, method 1000 includes step 1012, where a time $t_{thr}$ is recorded. Thus, time $t_{thr}$ is the time $t_{pre}$ elapsed since the preheat cycle was initiated to heat cooking chamber 104 to a temperature $T_{pre}$ such that the difference between temperature $T_{pre}$ and $T_{initial}$ is at least $T_{base}$.

As described above, the value $T_{base}$ may represent a difference or gap between the initial temperature $T_{initial}$ of cooking chamber 104 and the temperature $T_{thr}$ at threshold time $t_{thr}$ that is a typical gap between initial and threshold temperatures when cooking chamber 104 is preheating without a heavy load. That is, if cooking chamber 104 is not heavily loaded, when the preheating cycle has been operating for time $t_{thr}$, the air within cooking chamber 104 should have been heated to a sufficient temperature such that the difference between the initial temperature of cooking chamber 104 and the temperature at time $t_{thr}$ is at least $T_{base}$.

The value $T_{base}$ may be determined, e.g., experimentally and programmed into controller 140 as a predetermined value used during each iteration of method 300. As described above, in some embodiments, $T_{base}$ may be about 124° F. such that, for oven appliance 100 employing a value $T_{base}$ of about 124° F., if the difference between the initial temperature of the cooking chamber and the temperature of the cooking chamber at 400 seconds was not at least 124° F., then the controller could conclude that the cooking chamber was heavily loaded. In other embodiments, a nominal value of $T_{base}$ and one or more transfer functions may be determined, e.g., experimentally and programmed into controller 140 such that the value $T_{base}$ may be adjusted based on parameters such as, e.g., the established cook mode, the set cooking temperature, the initial temperature $T_{initial}$, the power or current draw by oven appliance 100 and/or heating elements 124, 126, 136, the supply voltage to oven appliance 100 and/or heating elements 124, 126, 136, and the temperature history of cooking chamber 104. Thus, in some embodiments, the value $T_{base}$ may vary after several iterations of method 1000 or from one iteration of method 1000 to another.

After recording time $t_{thr}$, method 1000 proceeds to step 614, where controller 140 determines whether cooking chamber 104 is heavily loaded. As illustrated in FIGS. 7 and 8, cooking chamber 104 may be determined to be heavily loaded if time $t_{thr}$ is greater than a time $t_{base}$. Time $t_{base}$ may represent the time required to reach at least a threshold temperature $T_{thr}$ when cooking chamber 104 is preheating without a heavy load, where threshold temperature $T_{thr}$ is equal to $T_{initial}$ plus $T_{base}$, that is, a temperature greater than $T_{initial}$ by the value $T_{base}$. Thus, as shown in FIG. 7, if time $t_{thr}$ equals or is less than time $t_{base}$, controller 140 may determine that cooking chamber 104 is lightly loaded. Likewise, as FIG. 8 illustrates, if time $t_{thr}$ exceeds time $t_{base}$, such that a longer time was required to heat cooking chamber 104 to threshold temperature $T_{thr}$, then controller 140 may determine that cooking chamber 104 is heavily loaded.

If cooking chamber 104 is determined to not be heavily loaded, i.e., cooking chamber 104 is lightly loaded, method 1000 proceeds to step 1014, and the preheat cycle continues without change. However, if cooking chamber 104 is determined to be heavily loaded, method 1000 includes step 1016 of notifying the user that cooking chamber 104 is heavily loaded, e.g., by notifying the user of one or more conditions that result from cooking chamber 104 being heavily loaded. The notification may be any audible and/or visual signal that indicates to the user that one or more conditions, such as, e.g., a longer preheat cycle, should be expected. By way of example, the notification may be text displayed on user interface 128, a verbal phrase, an LED light, and/or a buzzer. The user may also be notified via a wireless communication from oven appliance 100 to a mobile device, such as a cellular telephone, tablet, or laptop computer, and the notification may be, e.g., text and/or graphics displayed on the user's mobile device and/or an audible notification emitted through the user's mobile device. In other embodiments, the notification may be any other appropriate visual and/or audible signal.

As an example of a condition that may warrant a notification, if cooking chamber 104 is heavily loaded, the preheat cycle may be longer than the preheat cycle of a lightly loaded oven. Thus, a notification may be provided to the user through, e.g., a visual or audible signal, that the preheat cycle will be of a longer or an extended duration. Further, in some embodiments of oven appliance 100, if cooking chamber 104 is heavily loaded, cooking chamber 104 may have a different heat balance during the cooking cycle such that food items placed therein cook or brown faster in certain areas that in others. For example, food items or portions of food items closer to top wall 112 may cook or brown faster than food items or portions of food items that are further away from top wall 112. Accordingly, controller 140 may provide a notification that excessive cooking or browning can be expected for food items placed near top wall 112. It should also be appreciated that controller 140 may provide a notification to the user if cooking chamber 104 is lightly loaded, e.g., a lighted LED next to the text "Normal Preheat" may provide a notification that the preheat cycle will not be longer than usual. Other notifications, providing information about other conditions that may result when cooking chamber 104 is lightly or heavily loaded, may also be provided.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating an oven appliance, the oven appliance including a cooking chamber for receipt of food items for cooking, the method comprising:

establishing a cook mode of the oven appliance;

measuring a temperature $T_{initial}$;

initiating a preheat cycle of the oven appliance;

counting a time $t_{pre}$;

determining whether time $t_{pre}$ has reached a threshold time $t_{thr}$ and, if so, then measuring a temperature $T_{thr}$;

determining whether the cooking chamber of the oven appliance is heavily loaded and, if so, then increasing convection airflow within the cooking chamber.

2. The method of claim 1, wherein determining whether the cooking chamber is heavily loaded comprises calculating the difference between the temperatures $T_{thr}$ and $T_{initial}$.

3. The method of claim 1, wherein the cooking chamber is heavily loaded if the difference between the temperatures $T_{thr}$ and $T_{initial}$ is less than a value $T_{base}$.

4. The method of claim 1, further comprising continuing the preheat cycle if the cooking chamber is not heavily loaded when determining whether the cooking chamber is heavily loaded.

5. The method of claim 1, wherein increasing convection airflow comprises increasing a speed of a convection fan.

6. The method of claim 1, wherein increasing convection airflow comprises increasing a duty cycle of a convection fan.

7. The method of claim 1, further comprising returning to the step of counting time $t_{pre}$ if time $t_{pre}$ has not reached time $t_{thr}$ when determining whether time $t_{pre}$ has reached time $t_{thr}$.

8. An oven appliance, comprising:

a cabinet, the cabinet defining a cooking chamber configured for receipt of food items for cooking;

a heating element configured to heat the cooking chamber;

a fan; and a controller in operative communication with the heating element and the fan, the controller configured for establishing a cook mode of the oven appliance;

measuring a temperature $T_{initial}$;

initiating a preheat cycle of the oven appliance;

counting a time $t_{pre}$;

determining whether time $t_{pre}$ has reached a threshold time $t_{thr}$ and, if so, then measuring a temperature $T_{thr}$;

determining whether the cooking chamber of the oven appliance is heavily loaded and, if so, then increasing convection airflow within the cooking chamber.

9. The oven appliance of claim 8, wherein determining whether the cooking chamber is heavily loaded comprises calculating the difference between the temperatures $T_{thr}$ and $T_{initial}$.

10. The oven appliance of claim 8, wherein the cooking chamber is heavily loaded if the difference between the temperatures $T_{thr}$ and $T_{initial}$ is less than a value $T_{base}$.

11. The oven appliance of claim 8, wherein the controller is further configured for continuing the preheat cycle if the controller determines the cooking chamber is not heavily loaded.

12. The oven appliance of claim 8, wherein the controller is configured to increase a speed of the convection fan to increase the convection airflow within the cooking chamber.

13. The oven appliance of claim 8, wherein the controller is configured to increase a duty cycle of the convection fan to increase the convection airflow within the cooking chamber.

14. An oven appliance, comprising:

a cabinet, the cabinet defining a cooking chamber configured for receipt of food items for cooking;

a heating element configured to heat the cooking chamber;

a fan; and a controller in operative communication with the heating element and the fan, the controller configured for establishing a cook mode of the oven appliance;

measuring a temperature $T_{initial}$;

initiating a preheat cycle of the oven appliance;

counting a time $t_{pre}$; and determining whether the cooking chamber of the oven appliance is heavily loaded.

15. The oven appliance of claim 14, wherein the controller is further configured for, while counting the time $t_{pre}$:

determining whether time $t_{pre}$ has reached a threshold time $t_{thr}$ and, if so, then measuring a temperature $T_{thr}$.

16. The oven appliance of claim 15, wherein determining whether the cooking chamber is heavily loaded comprises calculating the difference between the temperatures $T_{thr}$ and $T_{initial}$, and wherein the cooking chamber is heavily loaded if the difference between the temperatures $T_{thr}$ and $T_{initial}$ is less than a value $T_{base}$.

17. The oven appliance of claim 16, wherein the value $T_{base}$ is a predetermined value programmed the controller.

18. The oven appliance of claim 16, wherein the value $T_{base}$ is a nominal value programmed into the controller, wherein one or more transfer functions are programmed into the controller, and wherein the nominal value of Tbase may vary over iterations of the method based on the one or more transfer functions.

19. The oven appliance of claim 14, wherein the controller is further configured for, while counting the time $t_{pre}$:

measuring a temperature $T_{pre}$;

determining whether the difference between temperature $T_{pre}$ and temperature $T_{initial}$ is at least a value $T_{base}$ and, if so, then recording a time $t_{thr}$.

20. The oven appliance of claim 14, wherein the controller is further configured for notifying a user of the oven appliance that the cooking chamber is heavily loaded if the controller determines the cooking chamber of the oven appliance is heavily loaded.

* * * * *